US011306437B2

(12) United States Patent
Straub

(10) Patent No.: US 11,306,437 B2
(45) Date of Patent: Apr. 19, 2022

(54) CLOTHING FOR A MACHINE FOR PRODUCING A FIBROUS WEB AND METHOD FOR PRODUCING A CLOTHING OF THIS TYPE

(71) Applicant: VOITH PATENT GMBH, Heidenheim (DE)

(72) Inventor: Michael Straub, Steinheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/971,999

(22) PCT Filed: Jan. 18, 2019

(86) PCT No.: PCT/EP2019/051198
§ 371 (c)(1),
(2) Date: Aug. 21, 2020

(87) PCT Pub. No.: WO2019/185210
PCT Pub. Date: Oct. 3, 2019

(65) Prior Publication Data

US 2020/0399829 A1 Dec. 24, 2020

(30) Foreign Application Priority Data

Mar. 26, 2018 (DE) ..... 10 2018 107 075.6

(51) Int. Cl.
*D21F 1/00* (2006.01)

(52) U.S. Cl.
CPC ..... *D21F 1/0063* (2013.01)

(58) Field of Classification Search
CPC ..... D21F 1/0063; D21F 7/083; D21F 7/10; D21F 1/0036; D21F 1/0054
See application file for complete search history.

(56) References Cited

U.S. PATENT DOCUMENTS 3,877,364 A 8/1975 Jacquelin
4,206,258 A * 6/1980 Balcar ..... B32B 5/06 428/131
4,537,658 A 8/1985 Albert
(Continued)

FOREIGN PATENT DOCUMENTS

DE 102005031276 A1 1/2007
DE 69834186 T2 4/2007
(Continued)

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A clothing for a machine for producing a fibrous web, more particularly a paper or cardboard web, is substantially formed from a film-shaped material having a first surface facing the fibrous web and a second surface facing away from the fibrous web. The clothing includes a plurality of through openings each extending along a central axis from the first surface to the second surface. The central axes of at least some of the through openings in the covering enclose an angle with the first surface which differs from 90°. A machine for producing a fibrous web, more particularly a paper or cardboard web, includes the clothing. A method for producing the clothing includes making the through openings in the film-shaped material by using a laser.

14 Claims, 2 Drawing Sheets

(56) References Cited

U.S. PATENT DOCUMENTS

| | | | | |
|---|---|---|---|---|
| 5,837,102 | A | 11/1998 | Graf | |
| 5,948,210 | A | 9/1999 | Huston | |
| 8,815,057 | B2 | 8/2014 | Eberhardt et al. | |
| 2013/0264318 | A1* | 10/2013 | Mourad | B32B 5/022 219/121.71 |

FOREIGN PATENT DOCUMENTS

| | | | |
|---|---|---|---|
| GB | 995620 | | 6/1965 |
| WO | 2010088280 | A1 | 8/2010 |
| WO | 2012028601 | A1 | 3/2012 |

* cited by examiner

CLOTHING FOR A MACHINE FOR PRODUCING A FIBROUS WEB AND METHOD FOR PRODUCING A CLOTHING OF THIS TYPE

BACKGROUND OF THE INVENTION

Field of the Invention

The present invention relates to a clothing for a machine for producing a fibrous web, in particular a paper or board web, which is substantially formed from a film-like material, having a first surface facing the fibrous web and a second surface facing away from the fibrous web, wherein the clothing comprises a plurality of passage openings, which each extend along a central axis from the first surface to the second surface.

Clothings for machines for producing a fibrous web, such as forming clothings for a paper machine, are currently still predominantly woven. However, the weaving process is both costly and time-consuming. Therefore, for a long time there has already been the aspiration to make such clothings from a film-like material, which can consist of a plastic and be extruded economically. The film-like material can either be produced in one layer or have multiple layers which together form a laminate. To achieve permeability of the film-like material for water, it must have passage openings. To this end, different methods have already been proposed, such as punching, mechanical drilling or providing pore formers in the film-like material, which form the passage openings following activation.

At this point, it should be noted that the term "film-like material" in the sense of the present invention is particularly preferably to be read as extruded plastic films, but does not necessarily have to be restricted thereto. Thus, this term can also relate to any type of flat and flexible elements which are not produced by weaving, that is to say, for example, even to felts or laid clothings.

The introduction of the passage openings into the film-like material by means of a laser has proven to be particularly advantageous, wherein the energy of the laser is used to evaporate the film-like material. Such a method is described, for example, in U.S. Pat. No. 5,837,102 and in WO 2012/028601 A1. FIG. 1 shows schematically how this method functions, wherein only a detail of a film-like material 12, which forms the base substrate of a clothing 10 to be produced (see FIG. 4), can be seen in FIG. 1. The film-like material 12 has a first surface 14 which, in the intended use of the clothing 10, faces the fibrous web, and a second surface 16 (see FIG. 4) opposite to the first surface 14. Optionally, the first surface 14 can have elevations 18 and/or depressions 20 introduced, for example as a result of embossing, as indicated in FIG. 1. However, the first surface 14 and the second surface 16 can substantially be imagined as flat. By means of a laser 22, a row of passage opening 24 is introduced into the film-like material 10, extending from the first surface 14 to the second surface 16. For this purpose, the laser 22 is driven via a line 28 by means of a controller 26 and, at predefined intervals, emits pulses of radiation 30, while the laser is moved relative to the film-like material 12. However, it is also possible to always move the film-like material 12 a little relative to the laser 22 and then to drill the same when it is at a standstill.

As can be seen in the sectional views of FIGS. 2 and 4 through the film-like material 12, the circumferential walls of the passage openings 24 extend substantially rotationally symmetrically around a respective central axis 32 of the passage opening 24. The passage openings 24 can substantially have the shape of a straight circular cylinder, as shown in FIG. 2, or else widen or taper conically, as shown in FIG. 3. The respective central axes 32 always extend rectilinearly, substantially orthogonally to the first surface 14 and second surface 16.

The clothing 10 shown in FIG. 4 can then be produced from the film-like material 12 perforated in this way. For this purpose, as a rule, longitudinal ends of the web-like film-like material 12 are connected to each other in a seam area, in order to make the clothing 10 endless. The clothing 10 is delimited by a first side edge 34 and a second side edge 36. Furthermore, the clothing 10 has a longitudinal direction LR extending parallel to the side edges 34 and 36, and a transverse direction QR extending orthogonally to the side edges 34 and 36.

It has transpired that the dewatering characteristics in the clothings described previously, which are known from the prior art, are not always optimal. A further problem with these clothings consists in the fact that the film-like material is highly weakened structurally because of the large number of passage openings. This has a detrimental effect on the capacity to absorb the forces acting upon the same in the intended use in the machine, in particular forces in the longitudinal direction.

SUMMARY OF THE INVENTION

It is an object of the present invention to solve or at least to minimize the aforementioned problems. This is achieved by the solution as claimed in the independent claims. Advantageous developments of the invention are, however, the subject matter of the subordinate claims.

In particular, the object is achieved by a clothing of the generic type and mentioned at the beginning which is additionally distinguished by the fact that the central axes of at least some passage openings of the clothing enclose an angle with the first surface which differs from 90°. The difference is preferably at least 1° and/or at most 45°, further preferably at least 2° and/or at most 30° and, still further preferably, at least 5° and/or at most 20°.

It has transpired that such an angular difference, which is also designated as inclination below, of the central axis of a passage opening relative to the orthogonal from the first surface has an influence on the dewatering capability of said passage opening. This finding can specifically be used to influence the dewatering capability of the entire clothing as required. If, for example, the central axis of a passage opening starting from the first surface which, in the intended use, faces the fibrous web, is inclined counter to the direction of movement of the clothing, suction forces act in the passage opening because of the movement of the clothing, which promote smooth dewatering of the fibrous web. In this way it becomes possible, for example, to provide fewer passage openings in the film-like material with the same dewatering capacity and/or to reduce the diameter of the passage openings, so that the film-like material is less highly weakened by the passage openings and can absorb more tensile forces. On the other hand, if the central axis of a passage hole starting from the first surface which, in the intended use, faces the fibrous web, is inclined in the direction of movement of the clothing, congestion forces act in the passage opening because of the movement of the clothing, which slow dewatering of the fibrous web. In this way, the dewatering can specifically be carried out more gently locally. This effect is also promoted by the fact that the channel length of the passage opening is enlarged because of the inclination. In order to achieve this, the central axes of the passage openings can additionally or alternatively also be inclined toward one of the two side edges of the clothing, starting from the first surface.

It is particularly advantageous if the central axes of at least two passage openings have angles which are different from each other, differing from 90° to the first surface. Thus, different regions of the clothing can be influenced differently with regard to their dewatering characteristics.

As already described previously, provision can be made for the central axis of at least one passage opening to have a directional component which is oriented parallel to the longitudinal direction of the clothing.

In this case, it may be advantageous if the directional components formed parallel to the longitudinal direction of the clothing of the central axes of most, preferably all, passage openings which have such a directional component point in the same direction. For example, all passage openings can have central axes with a directional component which, in intended use, starting from the first surface, point counter to the running direction of the clothing, in order in this way to increase the dewatering capability of the clothing.

As likewise described previously, it is alternatively or additionally also possible for the central axis of at least one passage opening to have a directional component which is oriented parallel to the transverse direction of the clothing.

In this case, it may be advantageous if the directional components formed parallel to the transverse direction of the clothing of the central axes of approximately half of the passage openings of which the central axes have such a directional component point in the opposite direction to the directional components formed parallel to the transverse direction of the clothing of the central axes of the remaining passage openings of which the central axes have such a directional component.

According to the invention, the clothing is delimited by a first side edge and a second side edge, wherein the passage openings of which the central axes have directional components running parallel to the transverse direction and which all point in the same direction are arranged closer to the first side edge of the clothing than the passage openings of which the central axes have directional components running parallel to the transverse direction which point in the opposite direction. In this way, for example, the dewatering capacity of the clothing can be designed symmetrically relative to a central region which is arranged between the two side edges of the clothing.

One advantageous development additionally provides for the clothing to have two side edges delimiting the same, wherein the central axis of at least one passage opening in an edge region adjacent to one of the two side edges, in particular viewed in the transverse direction of the clothing, has a greater difference from a 90° angle to the first surface than the central axis of at least one other passage opening in a central region, which is arranged centrally between the two side edges of the clothing. For example, the dewatering capability of the clothing can therefore decrease continuously from a central region, which is arranged centrally between the two side edges of the clothing, toward the two side edges.

In addition, the directional components oriented parallel to the longitudinal direction of the clothing, of the central axes of most, preferably all, passage openings of which the central axes have such a directional component can point in the same direction.

As already described at the beginning, the clothing according to the invention can be a forming clothing, in particular of a paper machine, i.e. a wire onto which a fibrous suspension is applied and through which a major part of the water contained in the fibrous suspension is led away.

A further aspect of the present invention relates to a machine for producing a fibrous web, in particular a paper or board web, comprising a clothing according to the invention described previously.

This clothing can be installed in a forming section of the machine. In principle, however, other parts or sections of the machine are also conceivable.

Preferably, the clothing is installed in the machine in such a way that the directional components oriented parallel to the longitudinal direction of the clothing of the central axes of most, preferably all, passage openings of which the central axes have such a directional component point in the direction opposite to the running direction of the clothing. In this way, the dewatering capability of the clothing can be increased.

A further aspect of the present invention relates to a method for producing a clothing according to the invention described previously, wherein the passage openings are introduced into the film-like material by means of a laser.

It is particularly preferable if, by means of mirror optics functionally connected to the laser, at least two passage openings which have angles which differ from each other, differing from 90° to the first surface, are introduced into the film-like material. By means of the mirror optics, the inclinations of the central axes of the passage openings can be set economically, without the entire laser having to be inclined relative to the first surface of the film-like material. It is also possible, by means of only one laser, to produce a whole row of passage openings in the film-like material in a short time, simply by a mirror in the mirror optics being adjusted appropriately.

The invention will be explained further below by using drawings, which are schematic and not to scale.

DETAILED DESCRIPTION OF THE INVENTION

Figure 5:
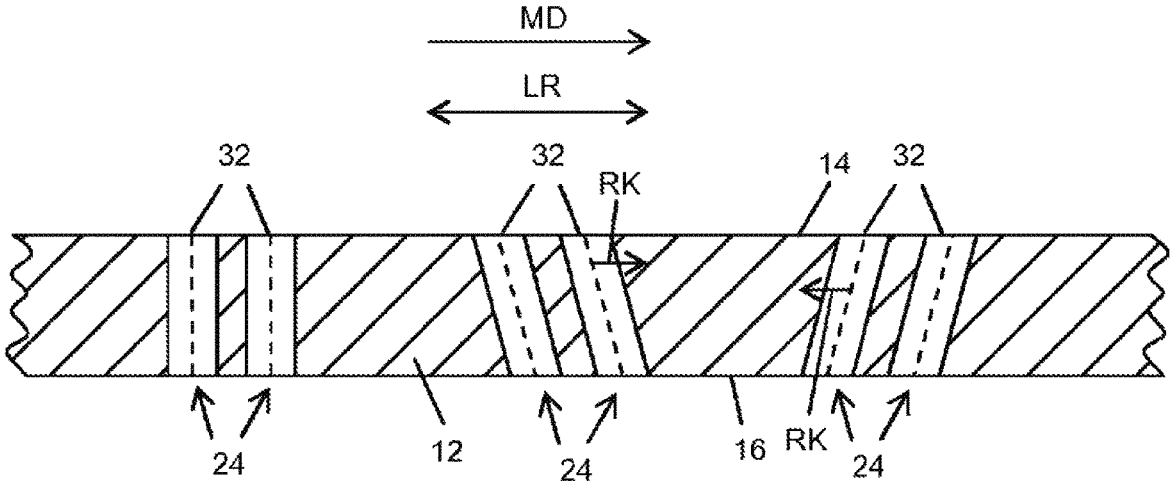
FIG. 5 shows a cross-sectional view of a section of the film-like material along the longitudinal direction of the clothing according to the invention.

FIG. 5 illustrates, schematically, a cross-sectional view of a section of the film-like material 12 along the longitudinal direction LR of the clothing 10 according to the invention. The clothing 10 or the film-like material 12 has a first surface 14 which, in the intended use of the clothing 10, faces the fibrous web forming on the same, and a second surface 16 opposite the first surface 14. In addition, it can be seen that, between the first surface 14 and the second surface 16, six passage openings 24 extend through the film-like material 12. The dewatering of the fibrous suspension for forming the fibrous web can be carried out through said passage openings 24. Each of the passage openings 24 has a respective rectilinear central axis 32 which, in the figures, is illustrated dashed. The walls of the passage openings 24 extend rotationally symmetrically around the corresponding central axis 32. In the present exemplary embodiment, the passage openings 32 are all cylindrical, but could also be conical, i.e. widen toward the first surface 14 and/or second surface 16.

Figure 1:
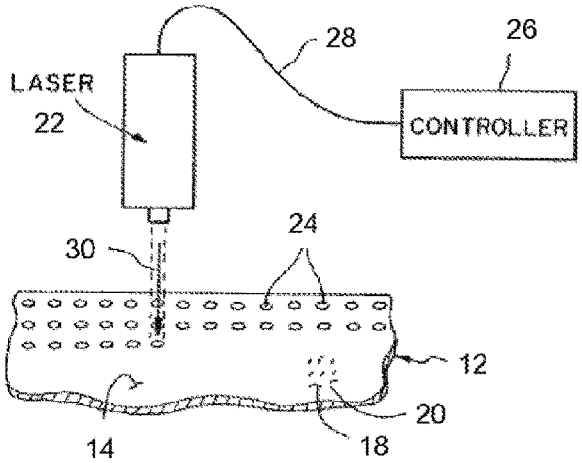
Fig. 1 (Prior art)
FIG. 1 shows a fragmentary, diagrammatic, perspective view of a prior art film-like material of a clothing being produced.
Figure 2:
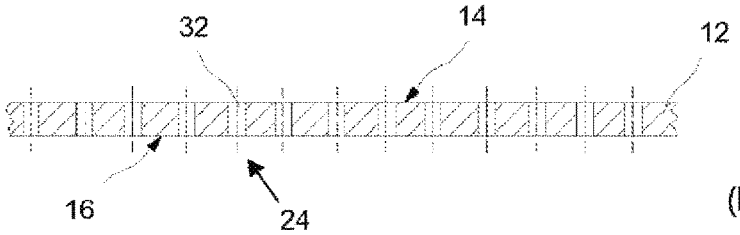
Fig. 2 (Prior art)
FIGS. 2 and 3 show cross-sectional views of the prior art film-like material.

The two passage openings 24 illustrated on the left in FIG. 5 have central axes 32 which extend substantially orthogonally to the first surface 14. This thus corresponds to the prior art described with regard to FIG. 2.

As opposed to this, the two passage openings 24 illustrated in the middle in FIG. 5 have central axes 32 which, with respect to the first surface, enclose an angle which, as can be seen, differs from 90°. In particular, the central axes 32 of these two passage openings 24 are inclined with respect to the first surface 14 such that the central axes 32 have a directional component RK which is oriented parallel to the longitudinal direction LR of the clothing 10. The directional component RK also points in the same direction as the running direction MD of the clothing 10 in the intended use. The dynamic forces acting during operation of the clothing 10 lead to a congestive action occurring in the central two passage openings 24, so that in the latter, the dewatering is slowed down as compared with the two left passage openings 24, of which the central axes 32 are aligned substantially orthogonally to the first surface 14, The two passage openings 24 illustrated on the right in FIG. 5 also have central axes which, with respect to the first surface, enclose an angle which, as can be seen, differs from 90°. Likewise, the central axes 32 of these two passage openings 24 are inclined with respect to the first surface 14 such that the central axes 32 have a directional component RK which is oriented parallel to the longitudinal direction LR of the clothing 10. However, as distinct from the two passage openings 24 illustrated in the middle in FIG. 5, the directional component RK of these two passage openings 24 points in the opposite direction to the running direction MD of the clothing 10 in the intended use. The dynamic forces occurring during operation of the clothing 10 lead to a suction action occurring in the two right-hand passage openings 24, so that the dewatering is accelerated as compared with the two passage openings 24 on the left, of which the central axes 32 are oriented substantially orthogonally to the first surface 14, and in particular as compared with the two central passage openings 24.

Figure 6:
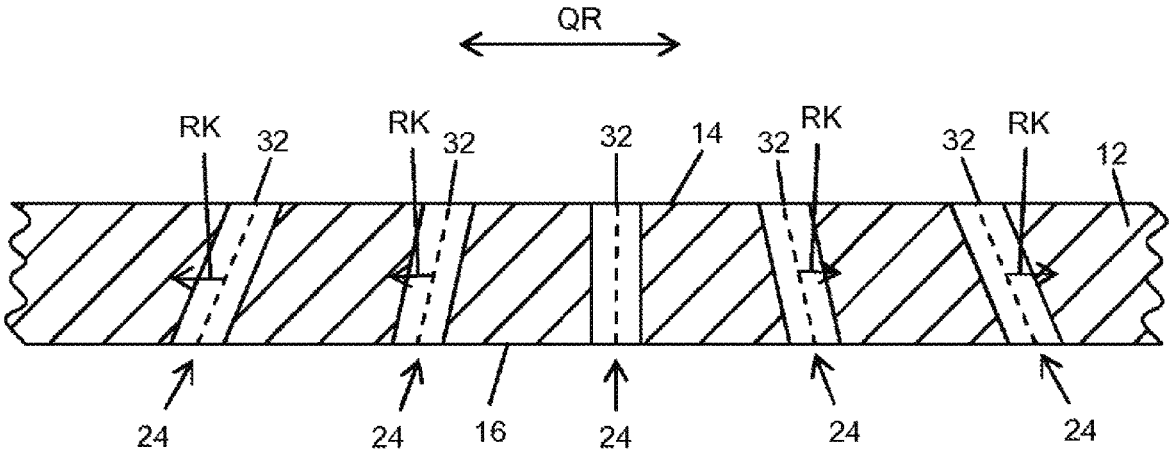
FIG. 6 shows a cross-sectional view of this section of the film-like material along the transverse direction of the clothing according to the invention.

FIG. 6 illustrates, schematically, a cross-sectional view of a section of the film-like material 12 along the transverse direction QR of the clothing 10 according to the invention. Visible in FIG. 6 are five passage openings 24, which each extend between the first surface 14 and the second surface 16 through the film-like material 12. Each of the passage openings 24 again has a respective rectilinear central axis 32. The walls of the passage openings 24 extend substantially rotationally symmetrically around the corresponding central axis 32.

The passage opening 24 illustrated in the middle in FIG. 6 has a central axis 32, which extends substantially orthogonally to the first surface 14. This thus corresponds to the prior art described with regard to FIG. 2.

As opposed to this, the two passage openings 24 illustrated on the left in FIG. 6 have central axes 32 which, with respect to the first surface 14, enclose an angle which, as can be seen, differs from 90°. In particular, the central axes 32 of these two passage openings 24 are inclined with respect to the first surface 14 such that the central axes 32 have a directional component RK which is oriented parallel to the transverse direction QR of the clothing 10. The directional component RK for these two passage openings 24 points to the left in FIG. 6.

The two passage openings 24 illustrated on the right in FIG. 6 also have central axes 32 which enclose an angle with respect to the first surface which, as can be seen, differs from 90°. Likewise, the central axes 32 of these two passage openings 24 are inclined with respect to the first surface 14 such that the central axes 32 have a directional component RK which is oriented parallel to the transverse direction QR of the clothing 10. However, as distinct from the passage opening 24 illustrated on the left in FIG. 6, the directional component RK of these two passage openings 24 points in the opposite direction, i.e. to the right in FIG. 6.

Figure 3:
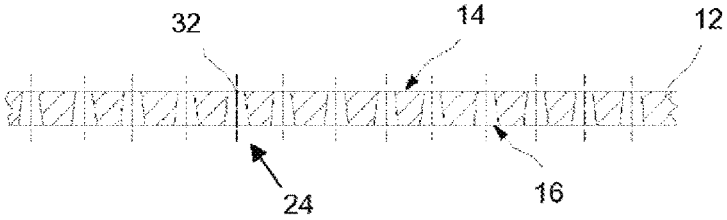
Fig. 3 (Prior art)
Figure 4:
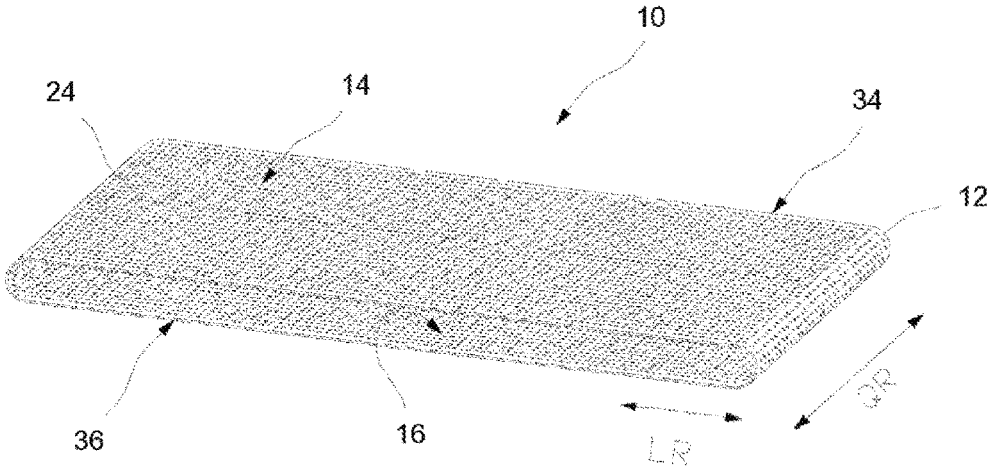
Fig. 4 (Prior art)
FIG. 4 shows a perspective view of the clothing.

As can be gathered further from FIG. 6, the inclination of the central axes 32 of the two outermost passage openings 24 to the orthogonal to the first surface 14 is greater than the inclination of the central axes 32 of the two passage openings 24 which are each arranged between the central passage opening 24 and the two outer passage openings 24. The steeper the inclination, the greater the channel length of the corresponding passage opening 24 is and the more slowly or more gently the dewatering is carried out. It may be advantageous that the passage opening 24 shown in the middle in FIG. 6, of which the central axis 32 is oriented substantially orthogonally to the first surface 14, is arranged in a central region which is located in the middle between the two side edges 34 and 36 (see FIG. 3) of the clothing. In this way, the dewatering characteristics can be provided substantially symmetrically relative to the transverse profile of the clothing 10.

It goes without saying that the examples illustrated in FIGS. 5 and 6 are intended merely to illustrate the basic principle of the present invention. The adjustment of the inclination of the central axes of the individual passage openings relative to the first surface can be carried out differently over the clothing as required, in order to obtain an optimal fibrous web that is matched to the needs.

LIST OF DESIGNATIONS

10 Clothing
12 Film-like material
14 First surface
16 Second surface
18 Elevation
20 Depression
22 Laser
24 Passage opening
26 Controller
28 Line
30 Pulse of radiation
32 Central axis
34 First side edge
36 Second side edge
LR Longitudinal direction
QR Transverse direction
RK Directional component
MD Running direction

The invention claimed is:

1. A clothing for a machine for producing a fibrous, paper or board web, the clothing comprising:

a film-shaped material having a first surface facing the fibrous web, a second surface facing away from the fibrous web, two side edges delimiting the clothing, two edge regions adjacent said two side edges, and a central region disposed centrally between said two side edges;

said film-shaped material having a multiplicity of passage openings each extending along a respective central axis from said first surface to said second surface;

said central axes of at least some of said passage openings enclosing an angle with said first surface differing from 90°; and said central axis of at least one of said passage openings in one of said edge regions having a greater difference from a 90° angle enclosed with said first surface than said central axis of at least one other of said passage openings in said central region to effect a desired dewatering of the fibrous web.

2. The clothing according to claim 1, wherein said central axes of at least two of said passage openings enclose angles with said first surface differing from each other.

3. The clothing according to claim 1, wherein said central axis of at least one of said passage openings has a directional component oriented parallel to a longitudinal direction of the clothing.

4. The clothing according to claim 1, wherein:

said central axes of a plurality of said passage openings have a directional component oriented parallel to a longitudinal direction of the clothing; and said directional components of said central axes of most or all of said plurality of said passage openings point in an identical direction.

5. The clothing according to claim 1, wherein said central axis of at least one of said passage openings has a directional component oriented parallel to a transverse direction of the clothing.

6. The clothing according to claim 1, wherein:

said central axes of a plurality of said passage openings have a directional component oriented parallel to a transverse direction of the clothing; and said directional components of said central axes of approximately half of said plurality of said passage openings point in a direction opposite to said directional components of said central axes of a remainder of said plurality of said passage openings.

7. The clothing according to claim 6, which further comprises:

a first side edge and a second side edge delimiting the clothing; and said passage openings having said central axes with directional components oriented parallel to the transverse direction and all pointing in an identical direction being disposed closer to said first side edge than said passage openings having said central axes with directional components oriented parallel to the transverse direction and pointing in the opposite direction.

8. The clothing according to claim 1, wherein said edge regions are viewed in the transverse direction of the clothing.

9. The clothing according to claim 1, wherein said clothing is a forming clothing or wire.

10. A machine for producing a fibrous, paper or board web, the machine comprising a clothing according to claim 1.

11. The machine according to claim 10, which further comprises a forming section of the machine, the clothing being installed in said forming section.

12. The machine according to claim 10, wherein:

said central axes of a plurality of said passage openings of the clothing installed in the machine have directional components oriented parallel to the longitudinal direction of the clothing; and said directional components of said central axes of most or all of said plurality of passage openings point in a direction opposite to a running direction of the clothing.

13. A method for producing a clothing for a machine for producing a fibrous, paper or board web, the method comprising the following steps:

providing a film-shaped material having a first surface facing the fibrous web, a second surface facing away from the fibrous web, two side edges delimiting the clothing, two edge regions adjacent the two side edges, and a central region disposed centrally between the two side edges;

using a laser to introduce a multiplicity of passage openings in the film-shaped material, each of the openings extending along a respective central axis from the first surface to the second surface;

orienting the central axes of at least some of the passage openings to enclose an angle with the first surface differing from 90°; and orienting the central axis of at least one of the passage openings in one of the edge regions to have a greater difference from a 90° angle enclosed with the first surface than the central axis of at least one other of the passage openings in the central region to effect a desired dewatering of the fibrous web.

14. The method according to claim 13, which further comprises using mirror optics functionally connected to the laser to introduce at least two of the passage openings into the film-shaped material at angles differing from one other and enclosing angles differing from 90° with the first surface.

* * * * *